US011066271B2

(12) United States Patent
Schloemer et al.

(10) Patent No.: US 11,066,271 B2
(45) Date of Patent: Jul. 20, 2021

(54) METHOD FOR OPERATING A TEXTILE MACHINE AND A TEXTILE MACHINE

(71) Applicant: Saurer Spinning Solutions GmbH & Co. KG, Uebach-Palenberg (DE)

(72) Inventors: Bert Schloemer, Heinsberg (DE); Dirk Brakensiek, Neuss (DE); Detlef Schelter, Erkelenz (DE); Michael Spitzer, Korschenbroich (DE)

(73) Assignee: Saurer Spinning Solutions GmbH & Co. KG, Uebach-Palenberg (DE)

( * ) Notice: Subject to any disclaimer, the term of this patent is extended or adjusted under 35 U.S.C. 154(b) by 57 days.

(21) Appl. No.: 16/260,862

(22) Filed: Jan. 29, 2019

(65) Prior Publication Data

US 2019/0233980 A1 Aug. 1, 2019

(30) Foreign Application Priority Data

Jan. 31, 2018 (DE) ..... 10 2018 102 135.6

(51) Int. Cl.
*B65H 54/22* (2006.01)
*D01H 11/00* (2006.01)
(Continued)

(52) U.S. Cl.
CPC ..... *B65H 54/22* (2013.01); *B65H 54/707* (2013.01); *D01H 4/08* (2013.01); *D01H 4/44* (2013.01);
(Continued)

(58) Field of Classification Search
CPC .. D01H 4/42; D01H 4/44; D01H 4/48; D01H 4/50; D01H 11/005; B65H 54/22; B65H 54/707
See application file for complete search history.

(56) References Cited

U.S. PATENT DOCUMENTS 4,893,462 A * 1/1990 Braun ..... D01H 4/24 57/263
9,103,053 B2 * 8/2015 Meyer ..... D01H 4/50
10,415,158 B2 * 9/2019 Stancl ..... D01H 4/48

FOREIGN PATENT DOCUMENTS

DE 3823289 A1 1/1989
DE 4446379 A1 * 6/1996 ..... B65H 54/70
(Continued)

OTHER PUBLICATIONS

Machine Translation DE 102007006679 A1, Retrieved Aug. 18, 2020.*
European Search Report from European Patent Application No. 19154516.9, dated Jan. 8, 2019 (all pages enclosed).

*Primary Examiner* — Shaun R Hurley
(74) *Attorney, Agent, or Firm* — Nelson Mullins Riley & Scarborough LLP

(57) ABSTRACT

A method for operating a textile machine with several identical workstations which each have a basic requirement for negative pressure for regular production operation and an additional requirement for negative pressure following an interruption to production at the workstation, and with a vacuum system with limited suction force to exert the negative pressure on the workstations. A minimum negative pressure ($p_{min}$) is set and the number workstations simultaneously supplied with additional negative pressure is limited so that the minimum negative pressure ($p_{min}$) is always met. In accordance with the invention, a sub-negative pressure ($p_{sub}$) is specified which is below the minimum negative pressure ($p_{min}$) and, if a specified event occurs, the number of workstations simultaneously supplied with additional negative pressure is temporarily limited so that the sub-negative pressure ($p_{sub}$) is always met.

8 Claims, 1 Drawing Sheet

(51) Int. Cl.

| | |
|---|---|
| ***D01H 4/08*** | (2006.01) |
| ***B65H 54/70*** | (2006.01) |
| ***D01H 4/44*** | (2006.01) |
| ***D01H 4/50*** | (2006.01) |

(52) U.S. Cl.
CPC ..... *D01H 4/50* (2013.01); *D01H 11/005* (2013.01); *B65H 2701/31* (2013.01)

(56) References Cited

FOREIGN PATENT DOCUMENTS

| | | | | | |
|---|---|---|---|---|---|
| DE | 19511960 | A1 * | 10/1996 | ..... | D01H 11/005 |
| DE | 10139075 | A1 | 2/2003 | | |
| DE | 102007006679 | A1 * | 8/2008 | ..... | B65H 54/707 |

* cited by examiner

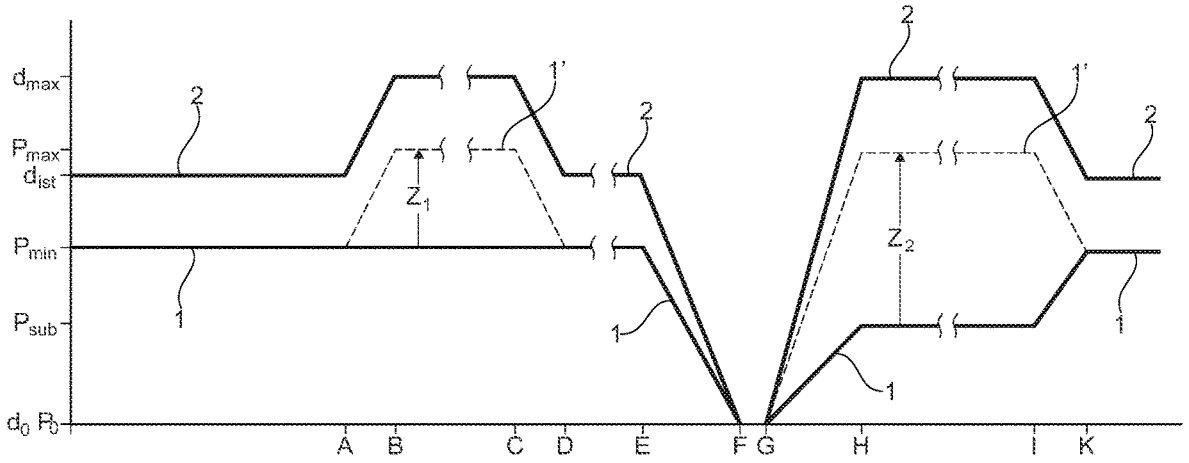
$d_{max}$
$P_{max}$
$d_{ist}$
$P_{min}$
$P_{sub}$
$d_0$ $P_0$
2
1
1'
$Z_1$
$Z_2$
A
B
C
D
E
F
G
H
I
K

METHOD FOR OPERATING A TEXTILE MACHINE AND A TEXTILE MACHINE

CROSS-REFERENCE TO RELATED APPLICATIONS

This application claims the benefit of German patent application DE 10 2018 102 135.6, filed Jan. 31, 2018, herein incorporated by reference in its entirety.

FIELD OF THE INVENTION

The invention relates to a method for operating a textile machine and a textile machine, more particularly to a method for operating a textile machine and a textile machine with several identical workstations which each have a basic requirement for negative pressure for regular production operation and an additional requirement for negative pressure following an interruption to production at the workstation, and with a vacuum system with limited suction force to exert the negative pressure on the workstations.

BACKGROUND OF THE INVENTION

In connection with textile machines, in particular textile machines that produce cross-wound packages, which have a large number of identical workstations, for example automatic winding machines or open-ended rotor spinning machines, it is known that to work properly they must constantly be supplied with suction air during their operation. Such a textile machine has one vacuum system with at least one controllable vacuum unit, the suction force of which can be regulated using the torque speed of a drive motor.

For example, constant negative spinning pressure is required to operate the workstations of open-ended rotor spinning machines. This negative spinning pressure arising in the rotor housing of the open-ended spinning devices ensures that during spinning operation, that a single fibre combed out from a sliver is pneumatically fed into a spinning rotor from a so-called opening roller via a fibre guide channel and is twisted into a yarn with the spinning rotor operating at a higher speed. This means that the workstations of open-ended rotor spinning machines have a specific, almost constant basic requirement for negative pressure during regular spinning operation.

The requirement for negative pressure of an individual workstation may, however, significantly increase, particularly if the workstations, as described for example in German Patent Document DE 101 39 075 A1 are designed as essentially autonomously operating workstations. Workstations of open-ended rotor spinning machines always have such an increased requirement for additional negative pressure if a workstation must be newly pieced up. This means that, following a spinning interruption, the yarn end running onto the surface of a cross-wound package through the workstation's own suction nozzle that is subject to negative pressure must be searched for, taken up, transported to the relevant open-ended spinning device and prepared for the spinning process.

Although open-ended rotor spinning machines usually have one vacuum system, with which the speed of the drive motor of the vacuum unit can be accelerated up to a maximum speed to increase the negative pressure level, there are often significant difficulties with these known textile machines if the total negative pressure requirement of the textile machine is more than the maximum negative pressure force that can be applied by the relevant vacuum system. This means that the vacuum system of the textile machine cannot provide sufficient negative pressure to supply all workstations requiring additional negative pressure with the necessary vacuum force without the negative spinning pressure required by the workstations falling below a minimum level at the same time, although the drive motor of the vacuum unit is already running at maximum speed.

Consequently, following a machine stoppage, only a very limited number of workstations can be supplied with additional negative pressure at the same time and therefore simultaneously pieced up again, with the consequence that a considerable amount of time elapses before an open-ended rotor spinning machine is running at full capacity again following a machine stoppage. Such machine stoppages occur relatively frequently in developing countries in particular, because in these countries disruptions to electricity supply systems are not a rare occurrence and such disruptions frequently lead to the textile machines being switched off.

There is also a machine stoppage for a regular lot change however. Even in such a case it takes a relatively long time until an open-ended rotor spinning machine is pieced up again due to the limited number of workstations that can be supplied with additional negative pressure simultaneously.

Even at the workstations of automatic winding machines, constant negative pressure is required, for example in order to operate a bobbin deduster, i.e. a device that ensures during the rewinding process, dirt and dust that occur as the yarn runs from the spinning bobbin are removed. In addition, the workstations of such textile machines have a so-called yarn trap, which is also constantly supplied with negative pressure during the rewinding process.

Moreover, at the workstations of such textile machines, a not insignificant additional negative pressure requirement arises if a yarn break occurs, or if the yarn is cut in a controlled cleaner cut. In these cases thread handling devices that are specific to each workstation and which negative pressure can be applied to are used, which ensure that the winding process at the affected workstation can be resumed as quickly as possible.

In order to be able to cover the negative pressure requirement of its workstations, which, as outlined above, can vary greatly, such textile machines also have, as described for example in German Patent Document DE 44 46 379 A or in German Patent Document DE 195 11 960 A1, a vacuum system for each machine with a vacuum unit the drive motor of which is connected to a frequency converter and which can be set specifically regarding its speed. This means that the speed of the drive motor can be adjusted depending on the negative pressure requirement of the textile machine within specific limits.

With such textile machines, the drive motor of the vacuum unit preferably runs during the regular work process at a speed at which the negative pressure in the vacuum system does not go below a certain minimum level, i.e. at which the so-called basic requirement for negative pressure of the textile machine is covered.

If an event is reported as a result of which there is an increased requirement for negative pressure, the speed of the drive motor of the vacuum unit is increased in order to supply a specifiable increased negative pressure, and in this way the increased requirement for negative pressure is met. The speed of the drive motor of the vacuum unit is adjusted in this context so that when the initial event requiring additional negative pressure, as well as further similar events occurring in the meantime, are being processed, the pressure level in the vacuum system is kept constantly at a minimum value. After the last of these events is processed, the speed of the drive motor of the vacuum unit is then again set at the speed required to cover the basic negative pressure requirement.

The methods described in German Patent Document DE 44 46 379 A or in German Patent Document DE 195 11 960 A are based on the so-called minimum principle, which involves attempting to reach a specific goal with the lowest possible resources. The above methods are however only successful if the negative pressure supplied is always more than the demand for negative pressure.

German Patent Document DE 10 2007 006 679 A1 also discloses a method that works according to the maximum principle. This means that with this known method, a value for a speed reserve is calculated from the maximum negative pressure of the vacuum system, which is specified using the known maximum speed of the drive motor of the vacuum unit as well as from the existing current speed of the drive motor of the vacuum unit, which is evident from the current negative pressure requirement of the textile machine. By means of this speed reserve value figure, the number of workstations still to be supplied with additional negative pressure is determined. From this number, with the addition of the number of workstations currently already supplied with additional negative pressure based on the current speed of the drive motor, a maximum number of workstations that still have to be supplied with additional negative pressure simultaneously is defined. Negative pressure requirements of workstations which exceed this maximum number of workstations that can be supplied with additional negative can be—at least initially—rejected.

SUMMARY OF THE INVENTION

The present invention is directed to the task of developing a method that, even under difficult conditions, enables the numerous workstations of a textile machine producing cross-wound packages to be brought back into operation again as promptly as possible.

To solve this problem, the present invention provides a method for operating and a textile machine with several identical workstations which each have a basic requirement for negative pressure for regular production operation and an additional requirement for negative pressure following an interruption to production at the workstation, and with a vacuum system with limited suction force to exert the negative pressure on the workstations is suggested. A minimum negative pressure is specified in this context. The number of workstations to be supplied with additional negative pressure simultaneously is limited so that the minimum pressure is always met. In accordance with the invention, a sub-negative pressure is specified which is below the minimum negative pressure and, if a specified event occurs, the number of workstations simultaneously supplied with additional negative pressure is temporarily limited so that the sub-negative pressure is always met.

Advantageous embodiments of the method in accordance with the invention are set forth herein.

The method in accordance with the invention has the particular advantage that in this way, the negative pressure potential made available to the textile machine by the vacuum system can be exploited to a large extent to supply additional negative pressure to the workstations. This means that the workstations of the textile machine have a significantly lower negative pressure requirement than workstations with a minimum negative pressure because the sub-negative pressure originally set as the operating pressure is below the minimum pressure that is usual during standard operation.

The drive motor of the vacuum unit of the vacuum system preferably runs at the same time at maximum speed and thereby generates a maximum pressure potential in the vacuum system of the textile machine. A relatively large reserve of negative pressure is then available, which can advantageously be used to provide a greater number of workstations with additional negative pressure, thereby enabling a number of further workstations to resume production. In the case of an open-ended rotor spinning machine, the resumption of production occurs by piecing up the workstations again.

The invention results in maximum quality with optimised production speed. It ensures that the minimum negative pressure required for quality in regular production operation is complied with. Only for particular specified events is the negative pressure reduced to the sub-negative pressure, in order to be able to resume regular production as quickly as possible. The quality impacts that may occur as a result of the lower negative pressure are overall negligible, because the sub-negative pressure is only employed for a brief period of time.

In a more advantageous embodiment, the event is the ramp-up time of the textile machine following a machine stoppage, during which all workstations have an additional requirement for negative pressure in order to resume production. If the sub-negative pressure is adjusted following a machine stoppage, the workstations of the textile machine can resume their regular production operation as quickly as possible. Such machine stoppages may occur, for example, as a result of disruptions in the electricity supply systems or lot changes.

Experience shows that electricity supply interruptions are a very frequent occurrence, particularly in developing countries, and unwanted machine stoppages occur almost regularly as a result.

Because both during an electricity supply disruption and a lot change, the textile machine initially stops, so that then all workstations of textile machines producing cross-wound packages must resume production and the ramp-up time of a textile machine, as is known, is always relatively short, if as many workstations of the textile machine as possible are to be pieced up again, after a machine stoppage the deployment of a very low sub-negative pressure means that the number of workstations that can be supplied with additional negative pressure simultaneously is significantly increased, thereby significantly decreasing the ramp-time of the textile machine.

According to an alternative to the present invention, the event is the ramping up of a group of workstations which require additional negative pressure at the same time. Such a definition of the event is reasonable, particularly for multi-lot operation of the textile machine. During multi-lot operation, there may be several groups of workstations at which different lots are being produced. A group of workstations then comprises several workstations on which the same lot is being produced. During a lot change, this group of workstations then has a requirement for additional negative pressure at the same time.

In a more advantageous embodiment, it is moreover envisaged that, by temporarily reducing the negative spinning pressure during ramping up to the sub-negative pressure, the number of workstations that can be supplied with additional negative pressure at the same time is increased from a somewhat low number to a significantly higher number. The number of workstations that can be supplied with additional negative pressure at the same time can be increased, for example, from approximately ten workstations, as previously standard, to approximately twenty workstations, which nearly halves the previously standard ramping up time for the textile machine.

The number of workstations that can be supplied with additional negative pressure at the same time is, however, not only dependent on the sub-negative pressure that is set, but also on further, sometimes very different factors.

The maximum number of workstations that can still be supplied with additional negative pressure at the same time also depends, for example, on the material and the material thickness of the packages to be manufactured on the workstations, the degree of soiling of the dirt chamber of the vacuum system, the installation height of the textile machine and similar parameters.

Coarser and hairier yarns, for example, require increased negative pressure in order to suck up a yarn end from a take-up package and prepare the yarn end in preparation tubes of the workstation for a yarn splice and be able to splice it into fine, smoother yarns. This means that the lower the negative pressure requirement of an individual workstation, the more workstations that can be supplied with additional negative pressure at the same time. Because the negative pressure ratios in the vacuum system of a textile machine are also constantly changing, for example due to increasing soiling of the dirt chamber, the pressure level in the vacuum is also constantly monitored and the number of workstations that still need to be supplied with additional negative pressure is continuously recalculated in a control unit of the textile machine.

Such a procedure not only ensures that the negative pressure level in the vacuum system does not sink below the specified sub-negative pressure temporarily required for operation by the workstations, but also guarantees that all workstations that are supplied with additional negative pressure also constantly receive sufficient negative pressure.

Preferably, the temporary reduction of the level of the negative pressure in the vacuum system to a sub-negative pressure is defined and set by the operating personnel. This means that such a reduction in the level of negative pressure in the vacuum system to a temporary sub-negative pressure, which is initiated by the operating personnel, can if needed, particularly following a machine stoppage, be reacted to instantly so that the subsequent resumption of production of the workstations of the textile machines takes as brief a period of time as possible.

To solve this problem a textile machine with several identical workstations which each have a basic requirement for negative pressure for regular production operation and an additional requirement for negative pressure following an interruption to production at the workstation, and with a vacuum system with limited suction force to exert the negative pressure on the workstations is also suggested. A control unit is present which can be used to specify a sub-negative pressure, and the control unit is designed so that the number of workstations simultaneously supplied with additional negative pressure is limited so that the sub-negative pressure is always met. In accordance with the invention, the control unit can also specify a sub-negative pressure which is below the minimum negative pressure. The control unit is designed in accordance with the invention so that, if a specified event occurs, the number of workstations simultaneously supplied with additional negative pressure is temporarily limited so that the sub-negative pressure is always met.

In accordance with the invention, the operator can thus enter two negative pressures in the control unit. These are firstly the minimum negative pressure which is used by the control unit during regular production operation as a lower limit, and secondly the sub-negative pressure, to which the negative pressure is reduced by the control unit during the specified event.

The textile machine in accordance with the invention, along with its control unit, is designed to carry out the method in accordance with the invention and its preferred embodiment.

Pursuant to one advantageous embodiment, the ramp-up of the textile machine following a machine stoppage, during which all workstations have an additional requirement for negative pressure, is stored as an event.

The ramp-up of a group of workstations which have a requirement for additional negative pressure at the same time can also be stored as an event in the control unit.

During the event specified in the control unit, the number of workstations that can be supplied with additional negative pressure simultaneously is preferably increased from a first number to a second number by the temporary reduction of the negative spinning pressure.

The method in accordance with the invention is preferably used in combination with an open-ended rotor spinning machine and the textile machine in accordance with the invention is preferably designed as an open-ended rotor spinning machine. Production operation is therefore spinning operation. Following the interruption of production, i.e. in this case an interruption to spinning, the additional negative pressure is required for piecing up the workstations again. The negative pressure is the negative spinning pressure.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The method in accordance with the invention is explained in greater detail below with an embodiment example shown schematically in the drawing. An open-ended rotor spinning machine is assumed in the embodiment example.

FIG. 1 shows schematically using a diagram with a curve 1 how the negative pressure p in the vacuum system of a textile machine changes.

DESCRIPTION OF THE PREFERRED EMBODIMENTS

Referring to FIG. 1, curve 1 shows how the negative pressure p changes, both during regular spinning operation and following the ramping up of the textile machine following a lot change or an involuntary machine stoppage. Curve 1 particularly shows the level of the negative spinning pressure that can be specified in the area of the workstations of a rotor spinning machine in the rotor housing of the open-ended spinning devices.

Curve 2 shows schematically how the speed of the drive motor of the vacuum unit of the textile machine changes, i.e. the change in speed of the drive motor both during regular spinning operation and following the ramping up of the textile machine following a lot change or an involuntary machine stoppage.

With $Z_1$ and $Z_2$, the number of workstations of the rotor spinning machine that can be simultaneously supplied with additional negative pressure and can therefore pieced up again is shown graphically.

$Z_1$ shows the number of workstations that can be supplied with additional negative pressure if the workstations have a minimum negative spinning pressure $p_{min}$. $Z_2$ shows the number of workstations that can be supplied with additional negative pressure if the workstations have a sub-negative spinning pressure $p_{min}$.

The x-axis shows the progress of time for the method in accordance with the invention, whereby the various points in time described in more detail below are identified as A, B, C etc.

The vertical axis shows the level of negative spinning pressure in the rotor housing with p, as well as the speed level of the drive motor of the vacuum unit of the textile machine with d.

As can be seen, the drive motor of the vacuum unit of the open-ended rotor spinning machine runs during regular spinning operation of the textile machine at a lower speed $d_{ist}$ compared to its maximum speed$_{max.}$. In the area of the rotor housing of the open-ended spinning devices of the workstations, a specifiable minimum negative spinning pressure $p_{min}$ is applied during this time. Because all workstations initially run regularly, the number of workstations that need to be supplied with additional negative pressure simultaneously is 0 at this time.

At time A, a number of workstations require additional negative pressure, for example because there are spinning interruptions at the workstations due to yarn breaks and the workstations need to be pieced up again.

In such a case, the control unit of the textile ensures that the drive motor of the vacuum unit is accelerated to its maximum speed $d_{max.}$. This maximum speed $d_{max.}$ is reached, for example at point in time B.

Due to the maximum speed $d_{max}$ of the drive motor of the vacuum unit the level of negative spinning pressure in the vacuum system is increased to a maximum negative spinning pressure $p_{max.}$, as is indicated by the dashed line 1', if at point in time B no additional negative pressure is required by the aforementioned workstations that need to be pieced up again, which is significantly greater than the minimum negative spinning pressure $p_{min}$.

However, the control unit of the textile machine has simultaneously calculated the number $Z_1$ of workstations that can be supplied with additional negative pressure simultaneously from point in time B, i.e. simultaneously pieced up again, without the negative spinning pressure in the vacuum system sinking below the minimum negative spinning pressure $p_{min.}$, i.e. despite a number $Z_1$ of workstations being supplied with additional negative pressure, the negative spinning pressure in the vacuum system remains at a minimum negative spinning pressure $p_{min.}$. It has calculated this number from the difference between the maximum negative spinning pressure $p_{max.}$ and minimum negative spinning pressure $p_{min.}$ as well as the additional negative pressure requirement of an individual workstation.

If, for example, at point in time C the piecing up of a number of workstations $Z_1$ is completed, the maximum speed $d_{max}$ of the drive motor of the vacuum unit is returned to the speed $d_{ist}$, which occurs at point in time D. The level of negative spinning pressure in the vacuum unit remains at a minimum negative spinning pressure $p_{min}$.

E shows the point in time at which a significant disruption to operation occurs. This means that at time E the rotor spinning machine switches off, for example due to an interruption in the electricity supply, and stops, which occurs at time F. At time F the speed of the drive motor is $d_0$ and the negative pressure in the vacuum system is accordingly $p_0$.

Because such a machine stoppage results in spinning interruptions at all workstations of the textile machine, all of the workstations of the rotor spinning machine must be pieced up again after the machine stoppage is over.

Because, as is known, the machine ramp-up time of a textile machine is also decisive for the overall efficiency of a machine, it is advantageous if all of the workstations of an affected textile machine are brought back into operation as quickly as possible following a machine stoppage. Therefore, in order to keep the ramp-up time of the textile machine as short as possible, as many workstations as possible must be pieced up again simultaneously, i.e. supplied with additional negative pressure simultaneously.

To this end, the operating personnel set a sub-negative spinning pressure $p_{sub}$ in the control unit of the textile machine. This means that, during the ramping up of the open-ended rotor spinning machine, a sub-negative spinning pressure $p_{sub}$, is temporarily applied in the area of the vacuum system of the textile machine, which is below the minimum negative spinning $p_{min.}$ which is standard during regular operation of the rotor spinning machine.

The restarting of the rotor spinning machine occurs at time G. Because there are a number of demands for additional negative pressure from workstations simultaneously at time G, which all want to be pieced up again immediately following a stoppage, the control unit of the textile machine ensures that the drive motor of the vacuum unit accelerates to its maximum speed $d_{max.}$, which is reached at time H. This means that, if there were no requirement for additional negative pressure from workstations wanting to be pieced up again, there would be a maximum negative spinning pressure $p_{max.}$ in the vacuum system of the textile machine at this point, as indicated by the dashed curve 1'. However, the control unit of the textile machine simultaneously calculated, from the difference between the set sub-negative spinning pressure $p_{sub}$ and the maximum negative spinning pressure $p_{max.}$ as well as the respective negative pressure of an individual workstation, the number $Z_2$ of workstations that need to be supplied with additional negative pressure simultaneously during the ramp-up of a textile machine, without the risk occurring that the negative pressure in the vacuum system of the textile machine would fall below the pre-specified sub-negative spinning pressure $p_{sub}$.

From time H onwards, a maximum possible number $Z_2$ of workstations is continuously simultaneously supplied with additional negative pressure, whereby, as explained above, it is ensured that the negative pressure in the vacuum system does not fall below the sub-negative spinning pressure level $p_{sub}$. After a specific time, indicated by time I, all workstations of the textile machine are pieced up again, i.e. there is no longer any additional requirement for negative pressure from the workstations. This means that at time I there is a situation where the negative pressure provided by the vacuum unit exceeds the demand for negative pressure due to the drive motor rotating at maximum speed $d_{max.}$. At time I, the speed $d_{max.}$ of the drive motor of the vacuum unit begins to be reduced, and at time K the speed is $d_{ist}$ once more. At the same time, the control unit of the textile machine corrects the negative spinning pressure set in the vacuum system of the textile machine. This means that the sub-negative spinning pressure $p_{sub}$, temporarily applied in the area of the vacuum system of the textile machine during ramping up of the open-ended rotor spinning machine is increased to the minimum negative spinning $p_{min.}$ which is standard during regular operation of the rotor spinning machine.

LIST OF REFERENCE NUMBERS

Curve 1 negative pressure level in the vacuum system
Curve 1' negative pressure at $p_{max}$ without additional pressure consumers
Curve 2 motor speed of the vacuum unit
A Time
B Time
C Time
D Time
E Time
F Time
G Time
H Time
I Time
K Time
$p_0$ negative pressure for a stopped vacuum unit
$p_{sub}$ sub-negative spinning pressure
$p_{min}$ minimum negative spinning pressure
$p_{max}$ maximum negative spinning pressure
$d_0$ speed of the motor in a stopped suction unit
$d_{ist}$ current speed of the motor
$d_{max}$ maximum speed of the motor
$Z_1$ number of additional workstations at $p_{min}$
$Z_2$ number of additional workstations at $p_{sub}$ It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A method for operating a textile machine with several identical workstations which each have a basic requirement for negative pressure for regular production operation and an additional requirement for negative pressure following an interruption to production at a workstation, and wherein the textile machine comprises a vacuum system with limited suction force to exert the negative pressure on the workstations, whereby a minimum negative spinning pressure ($p_{min}$) is set, wherein, at said minimum negative spinning pressure ($p_{min}$), an absolute value of the negative spinning pressure ($p_{min}$) is at its lowest level during standard operation; and whereby the number of workstations to be supplied with additional negative pressure simultaneously is limited so that the minimum negative pressure ($p_{min}$) is met, characterised in that a sub-negative spinning pressure ($p_{sub}$) is set, wherein an absolute value of the sub-negative spinning pressure ($p_{sub}$) is below the absolute value of the minimum negative spinning pressure ($p_{min}$) and upon the occurrence of a specified event, the number of workstations simultaneously supplied with additional negative pressure is temporarily limited so that the sub-negative pressure ($p_{sub}$) is met.

2. The method according to claim 1, characterised in that the event is a ramping-up of the textile machine following a machine stoppage, during which all workstations have an additional requirement for negative pressure.

3. The method according to claim 1, characterised in that the event is a ramping-up of a group of workstations which require additional negative pressure simultaneously.

4. The method according to claim 2, characterised in that during the event specified, the number of workstations supplied with additional negative pressure simultaneously is increased from a first number ($Z_1$) to a second number ($Z_2$) by the temporary reduction of the negative spinning pressure.

5. A textile machine with several identical workstations which each have a basic requirement for negative pressure for regular production operation and an additional requirement for negative pressure following an interruption to production at a workstation, and wherein the textile machine comprises a vacuum system with limited suction force to exert the negative pressure on the workstations, whereby a control unit is present and is used to specify a minimum negative pressure ($p_{min}$), wherein, at said minimum negative pressure ($p_{min}$), an absolute value of the minimum negative pressure ($p_{min}$) is at its lowest level during standard operation, and wherein the control unit is designed so that the number of workstations simultaneously supplied with additional negative pressure is limited so that the minimum negative pressure ($p_{min}$) is met, characterised in that, a sub-negative pressure ($p_{sub}$) is specified at the control unit, wherein an absolute value of the sub-negative pressure ($p_{sub}$) is below the absolute value for the minimum negative pressure ($p_{min}$), and that the control unit is designed so that, if a specified event occurs, the number of workstations simultaneously supplied with additional negative pressure is temporarily limited so that the sub-negative pressure ($p_{sub}$) is met.

6. The textile machine according to claim 5, characterised in that the control unit stores a ramping-up of the textile machine following a machine stoppage during which the workstations have an additional negative pressure requirement as an event.

7. The textile machine according to claim 5, characterised in that a ramping-up of a group of workstations which have a requirement for additional negative pressure at the same time is stored as an event in the control unit.

8. The textile machine according to claim 5, characterised in that during the event specified in the control unit, the number of workstations supplied with additional negative pressure simultaneously is increased from a first number ($Z_1$) to a second number ($Z_2$) by the temporary reduction of the negative spinning pressure.

* * * * *